United States Patent [19]

Yamamoto et al.

[11] 4,101,621

[45] Jul. 18, 1978

[54] METHOD FOR PRODUCING FLAME RESISTANT ACRYLIC FIBERS

[75] Inventors: Toshihiro Yamamoto; Yoshioki Okubo, both of Hofu; Kenichi Toyoda, Ube; Ryuji Yamamoto, Hofu, all of Japan

[73] Assignee: Kanebo, Ltd., Tokyo, Japan

[21] Appl. No.: 688,259

[22] Filed: May 20, 1976

[30] Foreign Application Priority Data

May 31, 1975 [JP] Japan ..... 50/65873
Feb. 28, 1976 [JP] Japan ..... 51/21662

[51] Int. Cl.[2] ..... D01F 6/38; C08F 259/04; C08F 259/06; C08F 265/08

[52] U.S. Cl. ..... 264/182; 260/32.6 N; 260/45.75 W; 260/45.7 S; 260/881

[58] Field of Search ..... 260/881, 45.75 W, 32.6 N; 264/182

[56] References Cited

U.S. PATENT DOCUMENTS 3,364,283 1/1968 Davis ..... 260/881
3,436,364 4/1969 Logemann et al. ..... 260/45.75 W X
3,573,235 3/1971 Yamamoto et al. ..... 260/881 X
3,903,038 9/1975 Neal ..... 260/45.75 W X
3,936,511 2/1976 Konig et al. ..... 260/881

*Primary Examiner*—Wilbert J. Briggs, Sr.
*Attorney, Agent, or Firm*—Blanchard, Flynn, Thiel, Boutell & Tanis

[57] ABSTRACT

Flame resistant acrylic fibers are produced by, in a solution polymerization of a mixture consisting of 30–80% by weight of acrylonitrile, 20–70% by weight of vinyl chloride or vinylidene chloride and 0–15% by weight of the other unsaturated monomer in a solvent of dimethylformamide, adding a polymer (referred to as blendmer) consisting of acrylonitrile, vinyl chloride or vinylidene chloride and an anionic monomer and zinc salt of an aromatic sulfonic acid prior to starting of the polymerization, subjecting the resulting mixture to the solution polymerization, removing unreacted monomers from the formed polymer solution, adding sulfur dioxide and adding water to adjust water content, spinning the thus formed spinning solution into an aqueous solution of dimethylformamide.

14 Claims, No Drawings

METHOD FOR PRODUCING FLAME RESISTANT ACRYLIC FIBERS

The present invention relates to a method for producing flame resistant acrylic fibers.

Heretofore, the general acrylic fibers have a bulky feeling, excellent physical properties, color fastness and dyeing brightness similar to wool, so that the acrylic fibers have been used in a broad field of uses. However, the acrylic fibers have the same flammability as a large number of natural fibers and synthetic fibers. For example, in the use for clothes, interior materials, industrial and building materials, acrylic fibers promote spread of fire, so that the demand therefor is limited. Accordingly, recently various attempts for improving the flammability of acrylic fibers and making them flame resistant have been made. Numerous processes for providing flame resistance to acrylic fibers have been already proposed. For example, a flame resistant monomer is copolymerized. Alternatively, a flame retardant is contained in or deposited on the fibers.

However, many of these processes cannot satisfy the requirements of washing resistance, dry cleaning resistance, feeling of fibers and the like and are not practical. In the former copolymerization process, the copolymerization of acrylonitrile (abbreviated as AN hereinafter) and vinyl chloride (abbreviated as VCl hereinafter) or vinylidene chloride (abbreviated as $VCl_2$ hereinafter) as a copolymerizable monomer having a double bond has been well known and the fibers consisting of the copolymer containing 25–70% by weight of these comonomers have a fairly high flame resistance.

However, when fibers are produced from the acrylic copolymer containing such a flame resistant monomer, two important problems of devitrification and discoloration are caused and these problems have not yet been satisfactorily solved. In order to solve the problem of devitrification, it has been proposed in Japanese Patent Application No. 102,184/74 that to a mixture consisting of 30–80% by weight of AN, 20–70% by weight of VCl or $VCl_2$ and the other unsaturated monomer with an organic solvent there is added a polymer consisting of 10–85% by weight of AN, 10–50% by weight of VCl or $VCl_2$ and 5–40% by weight of an anionic monomer in such an amount that the polymer is 0.1–10% by weight based on the total amount of the polymerization system, the polymerization is effected to obtain a spinning solution and then the spinning solution is spun into an aqueous solution of an organic solvent to form flame resistant acrylic fibers having no voids and a dense structure. However, it has been found that the acrylic polymer solution containing not less than 20% by weight, particularly not less than 30% by weight based on the total polymer is very readily discolored and further the flame resistant acrylic fibers obtained by spinning such a polymer solution considerably damage various commercial values and this tendency is particularly noticeable when dimethylformamide (abbreviated as DMF hereinafter) is used as a solvent.

It has been proposed in Japanese Patent Application Publication No. 892/72 that the addition of a metal salt of aromatic sulfonic acid can prevent the discoloration of the polymer solution in the solution polymerization of the vinyl monomer mixture containing not less than 80% by weight of AN but the acrylic fibers obtained by spinning said polymer solution after the unreacted monomers are removed, are considerably discolored and fibers having an excellent whiteness cannot be obtained.

In general, it has been known that the mechanism of discoloration of a flame resistant acrylic polymer solution having more than 20% by weight of VCl or $VCl_2$ and discoloration of a usual acrylic polymer solution having more than 80% by weight of AN is different and therefore the functional effect of a discoloration preventing agent is different and discoloration preventing agents effective for both the acrylic polymer solution are very few. Zinc salt of an aromatic sulfonic acid in a system wherein the unreacted monomer remains, shows a fairly high effect for preventing discoloration. However, the reason is not clear but such zinc salt is considerable in discoloration in the polymer solution wherein the unreacted monomers have been removed and even if zinc salt of an aromatic sulfonic acid can prevent discoloration during the polymerization reaction, the discoloration of the formed fibers cannot be prevented.

Furthermore, it has been disclosed in Japanese Patent Application Publication No. 8,386/64 that in a solution polymerization of not less than 85% by weight of AN and the other copolymerizable unsaturated vinyl compound in dimethylsulfoxide, sulfur dioxide is used as a discoloration preventing agent. But DMF solvent has a fairly higher tendency of discoloration than dimethylsulfoxide and further the discoloration mechanism in the polymer solution containing more than 20% by weight of VCl or $VCl_2$ is different from that in the polymer solution containing more than 80% by weight of AN as mentioned above. In general, a compound containing sodium sulfonate is often used as copolymerizing component for giving dyeability, but in this case, if sulfur dioxide is added prior to the polymerization, sulfur dioxide reacts with the above described sodium sulfonate during polymerization or in a step for removing the unreacted monomers at a high temperature to form sodium hydrogen sulfite or sodium sulfite, which makes the polymer solution dirty white and further retards filtration or clogs nozzles in the spinning step, and considerably lowers the operation. The inventors have diligently studied for obviating these defects and obtaining flame resistant acrylic fibers having no discoloration and an excellent whiteness and have accomplished the present invention.

An object of the present invention is to provide flame resistant acrylic fibers having an excellent whiteness and no devitrification.

Another object is to provide a method for producing, commercially easily and cheaply, flame resistant acrylic fibers having an excellent whiteness and no devitrification. The method of the present invention is characterized by the features that in a solution polymerization of a mixture of 30–80% by weight of acrylonitrile, 20–70% by weight of vinyl chloride or vinylidene chloride and 0–15% by weight of the other unsaturated monomer in dimethylformamide solvent, 0.1–10% by weight based on the total amount of the above described reaction system, of polymer (referred to as blendmer hereinafter) consisting of 10–85% by weight of acrylonitrile, 10–50% by weight of vinyl chloride or vinylidene chloride and 5–40% by weight of an anionic monomer, and 0.005–5.0% by weight based on the total amount of the above described reaction system, of zinc salt of an aromatic sulfonic acid are added thereto prior to the solution polymerization, the resulting mixture is polymerized, unreacted monomers are removed from the obtained polymer solution, then 0.005–3.0% by weight based on the amount of the polymer solution of sulfur dioxide is added to the polymer solution and further water is added before or after the addition of sulfur dioxide or together with sulfur dioxide to adjust water content in the polymer solution to 3.0–15.0% by weight, and then the thus obtained spinning solution is spun into an aqueous solution of dimethylformamide.

"The total amount of the reaction system" described above, means the total amount of the feeding liquid defined hereinafter, that is 30–80% by weight of AN, 20–70% by weight of VCl or $VCl_2$, 0–15% by weight of the other unsaturated monomer and DMF.

In the present invention, to a mixed liquid (referred to as "feeding liquid" hereinafter) consisting of AN, VCl or $VCl_2$ and the other unsaturated monomer, there is added a polymer consisting of AN, VCl or $VCl_2$ and an anionic monomer and the resulting mixture is polymerized. The composition of the blendmer varies depending upon the anionic monomer to be used in the blendmer but AN is 10–85% by weight, VCl or $VCl_2$ is 10–50% by weight and the anionic monomer is 5–40% by weight. The vinyl monomer in the blendmer may be either VCl or $VCl_2$, but it is economical that said vinyl monomer is the same as the kind of the flame resistant monomer (VCl or $VCl_2$) of the feeding liquid and further it is preferable that the used amount in both the monomers is approximate. When an amount of VCl or $VCl_2$ in the blendmer is less than 10% by weight, the flame resistance greatly lowers and the compatibility with the feeding liquid lowers. When said amount is more than 50% by weight, the polymerization percentage lowers and the discoloration becomes noticeable. When an amount of the anionic monomer is more than 40% by weight, the blendmer becomes water-soluble and an amount of the blendmer which flows out into the spinning bath upon spinning not only becomes large but also the heat resistance lowers. When said amount is less than 5% by weight, an effect for diminishing voids in the formed fibers is insufficient. Accordingly, as the composition of the blendmer, AN is 10–85% by weight, preferably 45–80% by weight, more particularly, 60–80% by weight, VCl or $VCl_2$ is 10–50% by weight, preferably 10–30% by weight, more particularly 10–25% by weight and the anionic monomer is 5–40% by weight, preferably 8–25% by weight, more particularly 8–15% by weight. The polymerization of the blendmer may be effected in any polymerization process of suspension polymerization, emulsion polymerization and solution polymerization, and is not particularly limited. An amount of the blendmer added is 0.1–10% by weight, preferably 0.5–5% by weight, more particularly 0.7–4% by weight based on the total amount of the reaction system. When an amount of the blendmer added is less than 0.1% by weight, the effect for preventing devitrification is low, while when said amount exceeds 10% by weight, the viscosity of polymerizing liquid upon polymerization is not only excessively increased, but also the dyeability of the formed fibers becomes too high and dyeing unevenness is caused. The blendmer may be added either prior to the polymerization or at the original stage of the polymerization reaction, but the addition prior to the polymerization is preferable. Even if the blendmer is added after the polymerization, the effect of the blendmer for preventing devitrification is recognized to a certain degree but the dispersing of the blendmer and the acrylic polymer is macro, so that a phase separation is apt to be caused and the gel stability of the polymer solution is not good and further the lustre of the final product lowers.

Adding of the blendmer may be effected by adding the blendmer alone, adding a DMF solution containing the blendmer dissolved therein or adding the polymer solution obtained by polymerization of the blendmer as such.

As the anionic monomers to be used in the blendmer, mention may be made of sulfonic acid monomers, such as allylsulfonic acid, methallylsulfonic acid, styrenesulfonic acid, 2-acrylamido-2-methyl-propanesulfonic acid, p-methallyloxybenzenesulfonic acid, allyloxybenzenesulfonic acid and sulfopropyl ester of methacrylic acid; carboxylic acid monomers, such as acrylic acid, methacrylic acid, itaconic acid and p-vinylbenzoic acid; alkali metal salts, alkaline earth metal salts and amine salts of these acids, but among them alkali metal salts of allylsulfonic acid, styrenesulfonic acid and 2-acrylamido-2-methyl-propanesulfonic acid are particularly preferable.

The concentration of the feeding monomers in the reaction mixture is usually 30–65% by weight, preferably 35–65% by weight so that a concentration of DMF is 35–70% by weight, preferably 35–65% by weight. The composition of the feeding monomers is a mixture of 30–80% by weight, preferably 45–75% by weight, more particularly 45–70% by weight of AN, 20–70% by weight, preferably 25–55% by weight, more preferably 30–55% by weight of VCl or $VCl_2$ and 0–15% by weight of the other unsaturated monomer. When the amount of AN is less than 30% by weight, the heat resistance lowers, while when said amount exceeds 80% by weight, an excellent flame resistance cannot be obtained. When the amount of VCl or $VCl_2$ exceeds 70% by weight, the heat resistance of the obtained fibers lowers and further the flame resistance reaches the saturated value, so that such an amount is not economical, while when said amount is less than 20% by weight, the flame resistance of the formed fibers is insufficient. When the amount of the other unsaturated monomer exceeds 15% by weight, the heat resistance of the formed fibers lowers. The unsaturated monomer is not particularly limited but, for example, acrylates, such as methyl acrylate, methacrylates, such as methyl methacrylate, acrylamides or mono, and dialkyl substituted compounds thereof, styrene or ring substituted compounds of styrene, vinyl acetate, vinyl esters of organic acids, such as vinyl benzoate, 2-vinyl-pyridine, alkyl substituted compounds of vinylpyridine, such as 2-methyl-5-vinylpyridine, sulfonic acids, such as allylsulfonic acid, methallylsulfonic acid, and styrenesulfonic acid and the salts of these acids are included and one or more of these compounds are conveniently selected depending upon the object.

As zinc salts of the aromatic sulfonic acid to be used in the present invention, for example zinc salts of the aromatic sulfonic acids, such as benzenesulfonic acid, o-toluenesulfonic acid, p-toluenesulfonic acid, p-phenolsulfonic acid, o-phenolsulfonic acid, p-chlorosulfonic acid, dodecylbenzenesulfonic acid, naphthalenesulfonic acid and the like are included and particularly zinc paratoluene sulfonate and zinc benzenesulfonate are preferable. These zinc salts of the aromatic sulfonic acids generally form salt hydrates but these salt hydrates may be used in the present invention. The amount of zinc salt of the aromatic sulfonic acids to be used is 0.005–5.0% by weight, preferably 0.01–2.0% by weight, more particularly 0.03–1.0% by weight based on the total amount of the reaction system. When the amount of zinc salt of the aromatic sulfonic acid is less than 0.005% by weight, the effect of such zinc salt for preventing discoloration is insufficient, while when said amount exceeds 5.0% by weight, the effect for preventing discoloration is not only saturated, but also the solubility against the reaction system lowers, so that such an amount should be avoided.

The catalyst for the polymerization may be any of the ones used in usual radical polymerization and is not particularly limited. For example, persulfates, such as ammonium persulfate, azobis compounds, such as azobisdimethylvaleronitrile and peroxides, such as benzoyl peroxide are included. The polymerization reaction is generally smoothly carried out at a temperature of 30°-75° C for 6-15 hours and when the polymerization percentage of the monomers reached 40-80%, the polymerization is completed. The separation and removal of the unreacted monomers after completion of the polymerization is effected under normal pressure but it is advantageous to carry out the separation and removal under a reduced pressure and in general the separation and removal are carried out at a temperature 50°-120° C, preferably 60°-100° C under a reduced pressure. After the unreacted monomers are removed from the obtained polymer solution under a reduced pressure, sulfur dioxide is added thereto in an amount of 0.005-3.0% by weight, preferably 0.01-2.0% by weight, more preferably 0.01-1.0% by weight based on the amount of the polymer solution. In this case, sulfur dioxide may be added in each state or in admixed state of a gaseous state, an aqueous solution and DMF solution. When the amount of sulfur dioxide added is less than 0.005% by weight, the effect for preventing discoloration is insufficient, while when said amount exceeds 3.0% by weight, the pH of the polymer solution is too low and reversely DMF is decomposed and the discoloration is promoted.

In the present invention, after the unreacted monomers are removed, water is added to the polymer solution to adjust water content in the polymer solution to 3.0-15.0% by weight, preferably 4.0-12.0% by weight, more particularly, 5.0-10.0% by weight and the thus obtained spinning solution is spun into an aqueous solution of DMF.

When the water content is less than 3.0% by weight, the effect for preventing devitrification of the product is insufficient, while when said amount exceeds 15.0% by weight, the effect for preventing devitrification reaches the saturated value and further the spinning solution is liable to form gel and a stable spinning becomes difficult.

In the present invention, in order to obtain the fibers having no devitrification, both the use of the blendmer and the addition of water are essential and if one of these requirements is not satisfied, a satisfactory result cannot be obtained. For example, if the generally used copolymerization process of the anionic monomer and the addition of water are combined, even though a certain degree of effect for preventing devitrification is obtained, the fibers having properties capable of being practically used and an excellent lustre as in the present invention can never be obtained. Moreover, even in the case where the blendmer alone is used without adding water, if an amount of the blendmer added is excessive, the effect for preventing devitrification may be obtained but the dyeability becomes too high and the heat resistance lowers and the physical properties of the fiber lower and commercially satisfactory fibers cannot be produced cheaply. In short, only by satisfying both of these two requirements is the present invention made feasible.

The addition of water is effected at any stage after the removal of the unreacted monomers and prior to spinning or water may be added together with sulfur dioxide. Water is generally added in an aqueous solution of DMF having a concentration of 50-80% by weight and then the spinning solution is stirred, whereby the aqueous solution of DMF is uniformly dissolved in the spinning solution.

After addition of sulfur dioxide and water, filtration is generally carried out to form the spinning solution. Furthermore, to the spinning solution may be added a delustrant, such as titanium oxide and the other flame retardant without damaging the effect of the present invention. The spinning solution is spun into an aqueous solution of DMF in a usual process. After spinning, general steps, such as drawing, washing with water, drying and heat treatment are carried out.

Acrylic fibers having excellent lustre and whiteness and no devitrification and having a permanent flame resistance can be obtained. Particularly, it is possible to obtain flame resistant acrylic fibers having a high quality by a commercially easy and cheap process.

The following examples are given for the purpose of illustration of this invention and are not intended as limitations thereof. In the examples, "parts" mean by weight.

EXAMPLE 1

In an autoclave, 26 parts of AN and 26 parts of VCl were dissolved in 45 parts of DMF together with 3 parts of a blendmer prepared from 57 parts of AN, 30 parts of $VCl_2$ and 13 parts of sodium allylsulfonate, in a conventional manner. Then, 0.09 part of zinc p-toluenesulfonate and 0.04 part of azobisdimethylvaleronitrile as a catalyst were added to the solution. After air in the autoclave was purged with nitrogen, a polymerization reaction was effected at 55° C for 9 hours to obtain a polymer solution containing a polymer, which had a molecular weight of 55,000, and had a transmissivity of 82% at a wave length of 420 mμ measured in a glass cell of 20 mm length (hereinafter, abbreviated as $T_{420}$) and a very high whiteness. After completion of the polymerization reaction, the polymer solution was diluted with 25 parts of DMF, and unreacted monomers were removed at 70° C under 100 mmHg to obtain a polymer solution having a $T_{420}$ of 75%. To 100 parts of the resulting polymer solution were added 0.3 part of a 10% by weight solution of $SO_2$ in DMF and 14.5 parts of a 60% by weight solution of DMF in water to prepare a spinning solution having a polymer concentration of 23.5% by weight, a water content of 5.1% by weight and a $T_{420}$ of 73%.

The spinning solution was extruded into a 58% by weight solution of DMF in water kept at 25° C through a spinneret having 1,000 holes of 0.1 mmϕ, and the extruded filaments were drawn to 10 times their original length. The drawn filaments were heat set at 110° C with steam to obtain filaments having a fineness of 3.1 deniers, a strength of 3.2 g/d, an elongation of 42%, a whiteness of 82% and a discoloration degree of as low as 10% and further having no devitrification. The resulting filaments were spun and woven into a blanket, and a burning test of the blanket was effected according to JIS L1091B. As the result, the char length of the filaments was found to be 5.70 cm and the filaments were excellent in the flame resistance. The above described whiteness of the filaments was shown by the reflectivity at a wave length of 475 mμ and the discoloration degree thereof was shown by the difference of the reflectivity at a wave length of 475 mμ and that at a wave length of 400 mμ.

COMPARATIVE EXAMPLE 1

A polymerization reaction and spinning were carried out in the exactly same manner as described in Example 1, except that $SO_2$ was added before the polymerization reaction in place of zinc p-toluenesulfonate. A comparison of the results of this Comparative Example 1 with those of Example 1 is shown in the following Table 1. In Table 1, the transmissivity at a wave length of 550 mμ (hereinafter abbreviated as $T_{550}$) shows the turbidity.

Table 1

| | Example 1 | | Comparative Example 1 | |
|---|---|---|---|---|
| | $T_{420}$ (%) | $T_{550}$ (%) | $T_{420}$ | $t_{550}$ |
| At the completion of the polymerization | 82 | 97 | 68 | 85 |
| After the dilution with 25 parts of DMF | 84 | 99 | 72 | 90 |
| After the removal of unreacted monomers | 79 | 97 | 47 | 62 |
| Just after the addition of $SO_2$ and $H_2O$ | 74 | 95 | 43 | 58 |
| 10 hours after the addition of $SO_2$ and $H_2O$ (50° C) | 73 | 95 | 18 | 20 |

As seen from Table 1, when $SO_2$ is added before the polymerization, the turbidity of the polymer solution is high, and the solution clogs the filter cloth and the spinneret to decrease considerably the spinnability and operation efficiency. When $SO_2$ is added only after the removal of unreacted monomers (Example 1), the polymer solution is not turbid and is not discolored.

COMPARATIVE EXAMPLE 2

In the same manner as described in Example 1, a polymerization reaction was effected, the resulting polymer solution was diluted with DMF, unreacted monomers were removed and water was added to the above treated polymer solution. Each of various additives shown in the following Table 2 was added to the polymer solution, and the resulting solution was left to stand for 5 hours at 50° C. Just after the addition of the additive and 5 hours after the addition, $T_{420}$ was measured. The obtained results are shown in Table 2.

Table 2

| | $T_{420}$ (%) | |
|---|---|---|
| | Just after the addition | 5 hours after the addition |
| 0.03 part of $SO_2$ (Example 1) | 74 | 74 |
| No addition of $SO_2$ (blank test) | 73 | 49 |
| 0.03 part of zinc p-toluenesulfonate | 74 | 52 |
| 0.03 part of zinc benzenesulfonate | 74 | 50 |
| 0.03 part of zinc phenolsulfonate | 74 | 51 |

As seen from Table 2, even when zinc salt of the aromatic sulfonic acid is added to a polymer solution after the removal of unreacted monomers, the transmissivity of the solution does not substantially different from that of blank test, and the effect of the addition of the zinc salt does not appear.

EXAMPLE 2

In an autoclave, 30 parts of AN, 20 parts of $VCl_2$, 2.0 parts of a blendmer, which had been prepared from 60 parts of AN, 20 parts of $VCl_2$ and 20 parts of sodium styrene-sulfonate, and zinc p-toluenesulfonate in an amount shown in the following Table 3 were dissolved in 48 parts of DMF, and then 0.04 part of azobisdimethylvaleronitrile was added to the solution. After air in the autoclave was purged with nitrogen, a polymerization reaction was effected at 57° C for 9 hours. The obtained results are shown in Table 3.

Table 3

| Amount of zinc p-toluenesulfonate based on the total amount of the reaction system (% by weight) | Results of polymerization | | |
|---|---|---|---|
| | Polymerization percentage (%) | $T_{420}$ (%) | $T_{550}$ (%) |
| 0 | 41 | 53 | 95 |
| 0.0025 | 42 | 58 | 95 |
| 0.005 | 41 | 78 | 96 |
| 0.1 | 40 | 83 | 97 |
| 3.0 | 41 | 84 | 93 |
| 5.0 | 41 | 80 | 88 |
| 7.0 | 40 | 68 | 76 |

As seen from Table 3, when the amount of zinc p-toluenesulfonate is less than 0.005% by weight based on the total amount of the reaction system, the discoloration of the polymer solution cannot be fully prevented, while when the amount exceeds 5.0% by weight, the zinc salt does not completely dissolve in the reaction system, and the polymer solution becomes turbid.

EXAMPLE 3

In an autoclave, 28 parts of AN, 28 parts of $VCl_2$ and 3 parts of a blendmer, which had been prepared from 77 parts of AN, 10 parts of $VCl_2$ and 13 parts of sodium allylsulfonate, and 0.03 part of zinc m-toluenesulfonate dissolved in 40 parts of DMF, and 0.045 part of azobisisobutyronitrile was added to the solution. After air in the autoclave was purged with nitrogen, a polymerization reaction was effected at 65° C for 10 hours to obtain a polymer solution having a $T_{420}$ of 80% and a $T_{550}$ of 95% in a polymerization percentage of monomer of 40%. The resulting polymer solution was diluted with 30 parts of DMF and unreacted monomers were removed at 75° C under 110 mmHg. Then, to 86 parts of the above treated polymer solution were added 14 parts of a 50% by weight solution of DMF in water and $SO_2$ in an amount shown in the following Table 4 to prepare a spinning solution. The spinning solution was left to stand for 5 hours at 50° C to examine the heat stability of the solution. The obtained results are shown in Table 4.

Table 4

| Addition amount of $SO_2$ based on the weight of the spinning solution (% by weight) | Just after the addition of $SO_2$ | | After left to stand for 5 hours at 50° 50°C | |
|---|---|---|---|---|
| | $T_{420}$ (%) | $T_{550}$ (%) | $T_{420}$ (%) | $T_{550}$ (%) |
| 0 | 74 | 95 | 49 | 95 |
| 0.003 | 74 | 95 | 56 | 95 |
| 0.005 | 75 | 93 | 69 | 93 |
| 0.1 | 76 | 95 | 73 | 94 |
| 1.0 | 74 | 96 | 72 | 92 |
| 3.0 | 74 | 95 | 71 | 94 |

Table 4-continued

| Addition amount of $SO_2$ based on the weight of the spinning solution (% by weight) | Just after the addition of $SO_2$ | | After left to stand for 5 hours at 50° 50°C | |
|---|---|---|---|---|
| | $T_{420}$ (%) | $T_{550}$ (%) | $T_{420}$ (%) | $T_{550}$ (%) |
| 5.0 | 73 | 92 | 52 | 82 |

As seen from Table 4, when the addition amount of $SO_2$ is less than 0.005% by weight based on the weight of the spinning solution, the discoloration of the spinning solution cannot be fully prevented, while the addition amount of $SO_2$ exceeds 3.0% by weight, the heat stability of the spinning solution lowers.

EXAMPLE 4

In 60 parts of DMF were dissolved 18 parts of AN, 15 parts of $VCl_2$ and 7 parts of sodium allylsulfonate, and 0.03 part of azobisisobutyronitrile was added to the solution, and a polymerization reaction was effected at 67° C for 10 hours under nitrogen atmosphere to obtain a blendmer solution containing a polymer having a molecular weight of 62,000 in a polymerization percentage of 47%. The resulting blendmer solution was used in an amount shown in the following Table 5 and a polymerization reaction was effected in the same manner as described in Example 1. The results of the polymerization reaction are shown in Table 5.

The resulting polymer solution was diluted with DMF, and unreacted monomers were removed at 70° C under 100 mmHg. Then, to 80 parts of the polymer solution were added 0.3 part of a 10% by weight solution of $SO_2$ in DMF and 20 parts of a 50% by weight solution of DMF in water to adjust the concentration of the polymer in the polymer solution to 22% by weight. The resulting spinning solution was extruded into a 60% by weight solution of DMF in water kept at 10° C through a spinneret having 1,000 holes of 0.1 mmϕ, and the extruded filaments were drawn to 10 times their original length, and the drawn filaments were heat set at 110° C with steam. The properties of the resulting filaments are shown in Table 5 together with the results of the polymerization reaction.

In Table 5, the percentage of initial dye exhaustion was measured in the following manner. The filaments were dyed with Aizen Cathilon Blue (trademark, made by Hodogaya Kagaku Co.) in an OWF of 3.0% and a bath ratio of 1:200 by raising the temperature of the dye bath from 60° to 85° C in 25 minutes at a rate of 1° C/min. In general, when the percentage of initial dye exhaustion exceeds 60%, uneven dyeing is apt to occur.

The char length of the filaments was measured according to JIS K1091B after the filaments were made into a carpet.

Table 5

| Experiment No. | Addition amount of the blendmer based on the total amount of the reaction system (% by weight) | Concentration of monomer (% by weight) | Polymerization percentage (%) | Molecular weight | Gloss | Char length (cm) | Percentage of initial dye exhaustion (% by weight) |
|---|---|---|---|---|---|---|---|
| 1 | 0 | 55 | 42 | 57,000 | x | 2.3 | 0 |
| 2 | 0.05 | 55 | 40 | 55,000 | Δ | 2.5 | 10 |
| 3 | 0.1 | 55 | 43 | 55,000 | | 2.8 | 20 |
| 4 | 1 | 53 | 40 | 53,000 | | 3.4 | 33 |
| 5 | 5 | 50 | 41 | 57,000 | | 4.4 | 49 |
| 6 | 10 | 47 | 43 | 55,000 | | 5.7 | 55 |
| 7 | 15 | 45 | 40 | 53,000 | | 6.5 | 80 |

Note:
: very good
: good
Δ : somewhat poor
x : poor

As seen from Table 5, when the addition amount of the blendmer is less than 0.1% by weight based on the total amount of the reaction system, the resulting filaments are devitrified and the percentage of initial dye exhaustion is low. While, when the addition amount of the blendmer exceeds 10% by weight, the percentage of initial dye exhaustion exceeds 60% by weight to cause uneven dyeing. Therefore, the addition amount of the blendmer is preferred to be 0.1–10% by weight based on the total amount of the reaction system.

EXAMPLE 5

The solubility in water of blendmers prepared from AN, $VCl_2$ and sodium allylsulfonate was examined. The obtained results are shown in the following Table 6.

Table 6

| Experiment No. | Weight ratio of AN | $VCl_2$ | sodium allylsulfonate | Cold water | Hot water |
|---|---|---|---|---|---|
| 1 | 78 | 20 | 2 | insoluble | insoluble |
| 2 | 75 | 20 | 5 | insoluble | insoluble |
| 3 | 70 | 20 | 10 | insoluble | insoluble |
| 4 | 60 | 20 | 20 | insoluble | partly soluble |
| 5 | 40 | 20 | 40 | mostly soluble | soluble |
| 6 | 30 | 20 | 50 | soluble | soluble |

In an autoclave, 3 parts of the above obtained blendmer, 25 parts of AN, 12 parts of $VCl_2$ and 1 part of methyl acrylate were dissolved in 59 parts of DMF, and to the solution was added 0.04 part of azobisdimethylvaleronitrile as a catalyst. After air in the autoclave was purged with nitrogen, a polymerization reaction was effected at 55° C for 10 hours to obtain a polymer solution. The conversion of the blendmer is shown in the following Table 7. The resulting polymer solution was diluted with 20 parts of DMF, and unreacted monomers were removed at 70° C under 100 mmHg. Then, water was added to the polymer solution to produce a spinning solution having a polymer concentration of 23% by weight and a water content of 6.0% by weight. The spinning solution was extruded into a 60% by weight solution of DMF in water kept at 10° C through a spinneret having 1,000 holes of 0.1 mmϕ, the extruded filaments were drawn to 10 times their original length, and the drawn filaments were heat set at 120° C with steam.

The gloss of the resulting filaments is shown in Table 7.

Table 7

| Experiment No. | Gloss (void) Drawn filaments | Gloss (void) Heat set filaments | Conversion of the blendmer |
|---|---|---|---|
| 1 | × | Δ | 100 |
| 2 | Δ | | 100 |
| 3 | | | 100 |
| 4 | | | 95 |
| 5 | | | 60 |
| 6 | | | 17 |

As seen from Table 7, when the amount of anionic monomer in the blendmer is less than 5% by weight, the devitrification of the resulting filaments cannot be fully prevented, while when the amount of anionic monomer exceeds 40% by weight, the blendmer is soluble in hot water, and is dissolved out at the spinning and washing with water. Therefore, the proper amount of anionic monomer in the blendmer is 5–40% by weight.

EXAMPLE 6

A monomer mixture of AN and $VCl_2$ in a mixing ratio shown in the following Table 8 was charged in an autoclave in a variant amount shown in Table 8 together with 1.5 parts of a blendmer, which had been prepared from 60 parts of AN, 20 parts of $VCl_2$ and 20 parts of sodium styrenesulfonate, and further 0.1 part of zinc p-toluenesulfonate and 0.04 part of azobisdimethylvaleronitrile, and to the mass was added DMF to make up the total amount to 100 parts. After air in the autoclave was purged with nitrogen, a polymerization reaction was effected at 55° C for 10 hours to obtain a polymer solution. Then, the dilution of the polymer solution, the removal of unreacted monomers and the addition of $SO_2$ and water were carried out in the same manner as described in Example 1 to obtain a spinning solution.

The spinning solution was spun in the same manner as described in Example 1. The char length and the shrinkage at 130° C of the resulting filaments are shown in Table 8 together with the results of the polymerization reaction.

Table 8

| Experiment No. | Monomers fed: Total amount of AN and $VCl_2$ (parts) | Monomers fed: Weight ratio of AN:$VCl_2$ | Results of polymerization reaction: Polymerization percentage (%) | Results of polymerization reaction: $T_{420}$ (%) | Char length (cm) | Shrinkage at 130° C (%) |
|---|---|---|---|---|---|---|
| 1 | 33 | 90:10 | 47 | 93 | 32.5 | 10 |
| 2 | 40 | 80:20 | 45 | 85 | 9.2 | 15 |
| 3 | 53 | 60:40 | 40 | 80 | 4.5 | 30 |
| 4 | 70 | 30:70 | 35 | 59 | 2.2 | 50 |
| 5 | 80 | 10:90 | 27 | 19 | 1.0 | 90 |

As seen from Table 8, when the amount of $VCl_2$ in the monomer mixture is less than 20% by weight, the flame resistance of the resulting filaments is insufficient, while when the amount of $VCl_2$ in the monomer mixture exceeds 70% by weight, the polymer solution has a high $T_{420}$, that is, discolors noticeably, and moreover the resulting filaments are very poor in the resistance against heat shrinkage.

EXAMPLE 7

In an autoclave, 30 parts of AN, 20 parts of $VCl_2$, 2 parts of a blendmer, which had been prepared from 65 parts of AN, 15 parts of $VCl_2$ and 20 parts of sodium allylsulfonate, and 0.05 part of zinc p-toluenesulfonate were dissolved in 48 parts of DMF, and 0.04 part of azobisdimethylvaleronitrile was added to the solution. After air in the autoclave was purged with nitrogen, a polymerization reaction was effected at 57° C for 9 hours to obtain a polymer solution containing a polymer, which had a molecular weight of 57,000, and having a $T_{420}$ of 82% and a $T_{550}$ of 96% in a polymerization percentage of 45%. After the resulting polymer solution was diluted with DMF, unreacted monomers were removed at 90° C under 100 mmHg, and 0.02 part of $SO_2$ and a variant amount of water were added to the polymer solution to obtain a spinning solution. The spinning solution was extruded into a 60% by weight solution of DMF in water kept at 15° C through a spinneret having 1,000 holes of 0.1 mmϕ, and the extruded filaments were drawn to 8 times their original length and heat set at 120° C with steam.

Properties of the spinning solution and the resulting filaments are shown in the following Table 9 together with the water content and polymer concentration in the spinning solution.

Table 9

| Experiment No. | Water content in the spinning solution (% by weight) | Polymer concentration in the spinning solution (% by weight) | Falling ball Viscosity of the spinning solution (sec) | Gloss (Void) of the drawn filaments | BA value of the heat set filaments (%) |
|---|---|---|---|---|---|
| 1 | 0 | 24.2 | 40 | x | 21 |
| 2 | 2 | 24.1 | 42 | x | 40 |
| 3 | 3 | 23.2 | 47 | | 69 |
| 4 | 4 | 23.0 | 43 | | 83 |
| 5 | 5 | 23.0 | 50 | | 86 |
| 6 | 7 | 23.5 | 49 | | 83 |
| 7 | 10 | 23.8 | 49 | | 85 |
| 8 | 12 | 23.1 | 48 | | 84 |
| 9 | 15 | 23.9 | 62 | | 82 |
| 10 | 18 | 23.0 | gelled | — | — |

In the above Table 9, the falling ball viscosity of the spinning solution was measured as follows. A glass tube having an inner diameter of 2.5 cm and filled with the solution is placed in a thermostat kept at 50° C, and a time required for dropping a steel ball having a diameter of ⅛ inch and a weight of 0.12–0.13 g in the solution in a distance of 20 cm is expressed by second, which is the falling ball viscosity of the spinning solution.

The BA value of the heat set filaments was measured as follows. The heat set filaments are degreased, combed, arranged in parallel and cut into a length of 3 cm. 40 mg of the filaments is charged into a glass cell having a length of 2 cm, and 7 ml of benzyl alcohol (first grade reagent) is added to the cell. After the filaments are immersed in the benzyl alcohol for 30 minutes, the transmissivity (%) of the mass through the cell is measured at a wave length of 562 mμ, which is the BA value of the heat set filaments. The larger is the BA value of filaments, more excellent gloss the filaments have.

It can be seen from Table 9 that, when the water content in the spinning solution is less than 3% by weight, the resulting filaments are insufficient in both of gloss (void) and BA value, while when the water content exceeds 15% by weight, the spinning solution is gelled and cannot be spun in a stable state.

The filaments of sample Nos. 3–9 are excellent in the gloss, and further when the filaments were knitted into a blanket, the filaments showed a char length of about 5 cm, and had a permanent flame resistance.

EXAMPLE 8

27.5 parts of AN, 22.5 parts of $VCl_2$, 0.1 part of zinc p-toluenesulfonate, 0.05 part of azobisdimethylvaleronitrile and a compound, the kind and amount of said compound being shown in the following Table 10, were mixed. Then, DMF was added to the mixture to make up the total amount to 100 parts, and a polymerization reaction was effected at 55° C for 9 hours to obtain a polymer solution in a polymerization percentage of 43.5%. Thereafter, the polymer solution was treated in the same manner as described in Example 7 to obtain heat set filaments. However, in this treatment, the amount of water to be added was varied as shown in Table 10. The resulting filaments were compared with each other in the gloss and BA value. The obtained results are shown in Table 10.

Table 10

| Experiment No. | Compound added before the polymerization: Kind | Addition amount based on the total amount of the reaction system (% by weight) | Addition amount of water based on the amount of the spinning solution (% by weight) | Gloss of the drawn filaments | BA value of the heat set filaments (%) | Remarks |
|---|---|---|---|---|---|---|
| 1 | Sodium allylsulfonate | 1 | 12 | x | 10 | Comparative Example |
| 2 | " | 1.5 | 12 | x | 14 | " |
| 3 | Sodium styrenesulfonate | 1 | 12 | x | 12 | " |
| 4 | Blendmer prepared from 50 parts of AN, 30 parts of $VCl_2$ and 20 parts of sodium allylsulfonate | 2.5 | 0 | x | 36 | " |
| 5 | " | 4.5 | 0 | x | 48 | " |
| 6 | " | 8.3 | 0 | Δ | 52 | " |
| 7 | " | 2.5 | 5 | | 83 | Present invention |
| 8 | " | 4.5 | 5 | | 85 | " |
| 9 | " | 8.3 | 5 | | 88 | " |

Experiment Nos. 1–3 shown as a Comparative Example are conventional copolymerization processes, and even when a large amount of water is added to the spinning solution in these conventional processes, filaments having excellent gloss cannot be obtained. Further, the filaments of Experiment Nos. 4–6, wherein a blendmer is used in the polymerization but water is not added to the spinning solution, are apparently inferior to the filaments of Experiment Nos. 7–9, wherein a blendmer is used in the polymerization and water is added to the spinning solution, in the gloss and BA value.

What is claimed is:

1. A method for producing flame-resistant acrylic fibers, which comprises the steps of:

1. prior to starting solution polymerization, adding to
   (a) a solution of monomers dissolved in dimethylformamide, wherein said monomers consist essentially of from 30 to 80% by weight of acrylonitrile, from 20 to 70% by weight of vinyl chloride or vinylidene chloride and from 0 to 15% by weight of other unsaturated monomer,
   (b) from 0.1 to 10% by weight, based on the weight of (a), of a polymer consisting essentially of from 10 to 85% by weight of acrylonitrile, from 10 to 50% by weight of vinyl chloride or vinylidene chloride and from 5 to 40% by weight of an anionic monomer, and
   (c) from 0.005 to 5.0% by weight, based on the weight of (a), of zinc salt of an aromatic sulfonic acid, whereby to form a polymerization mixture,
2. then polymerizing said polymerization mixture under solution polymerization conditions to polymerize the monomers of component (a),
3. then removing unreacted monomers from the product of step 2 to obtain a polymer solution,
4. then adding from 0.005 to 3.0% by weight, based on the weight of said polymer solution, of sulfur dioxide, and adding water so that the water content of said polymer solution is from 3.0 to 15% by weight whereby to form a spinning solution, and
5. then spinning said spinning solution into an aqueous solution of dimethylformamide to form fibers.

2. A method as claimed in claim 1, wherein said component (b) polymer consists of 45–80% by weight of acrylonitrile, 10–30% by weight of vinyl chloride or vinylidene chloride and 8–25% by weight of anionic monomer.

3. A method as claimed in claim 1, wherein the amount of component (b) added is 0.5–5.0% by weight, based on the weight of (a).

4. A method as claimed in claim 1, wherein the concentration of dimethylformamide in component (a) is 35–65% by weight.

5. A method as claimed in claim 1, wherein the zinc salt of the aromatic sulfonic acid is zinc paratoluenesulfonate or zinc benzenesulfonate.

6. A method as claimed in claim 1, wherein the amount of the zinc salt of the aromatic sulfonic acid is 0.01–2.0% by weight, based on the weight of (a).

7. A method as claimed in claim 1, wherein the amount of sulfur dioxide is 0.01–2.0% by weight, based on the weight of said polymer solution.

8. A method as claimed in claim 1, wherein the water content in said spinning solution is 4–12% by weight.

9. A method as claimed in claim 8, wherein said water content is 5–10% by weight.

10. A method as claimed in claim 1, wherein said anionic monomer is an alkali metal salt of allylsulfonic acid, methallylsulfonic acid, styrenesulfonic acid or 2-acrylamido-2-methyl-propanesulfonic acid.

11. A method as claimed in claim 1, wherein the solution polymerization is effected in the presence of a radical polymerization catalyst.

12. A method as claimed in claim 1, wherein the solution polymerization is completed when the polymerization percentage of the monomers reaches 40–80%.

13. A method for producing flame-resistant acrylic fibers, which comprises the steps of:

1. prior to starting solution polymerization, adding to
   (a) a solution of monomers dissolved in dimethylformamide, wherein said monomers consist essentially of from 45 to 75% by weight of acrylonitrile, from 25 to 55% by weight of vinyl chloride or vinylidene chloride and from 0 to 15% by weight of other unsaturated monomer, said solution containing from 35 to 70% by weight of dimethylformamide,
   (b) from 0.5 to 5.0% by weight, based on the weight of (a), of a polymer consisting essentially of from 45 to 80% by weight of acrylonitrile, from 10 to 30% by weight of vinyl chloride or vinylidene chloride and from 8 to 25% by weight of an anionic monomer selected from the group consisting of sulfonic acid monomers, carboxylic acid monomers and alkali metal salts, alkaline earth metal salts and amine salts of said sulfonic acid and carboxylic acid monomers, and
   (c) from 0.01 to 2.0% by weight, based on the weight of (a), of zinc salt of an aromatic sulfonic acid, whereby to form a polymerization mixture,
2. then polymerizing said polymerization mixture under solution polymerization conditions, in the presence of a radical polymerization catalyst, to polymerize from 40 to 80% of the monomers of component (a),
3. then heating the product of step 2 at 50° to 120° C to remove unreacted monomers whereby to obtain a polymer solution,
4. then adding from 0.01 to 2.0% by weight, based on the weight of said polymer solution, of sulfur dioxide, and adding water so that the water content of said polymer solution is from 4.0 to 12% by weight whereby to form a spinning solution, and
5. then spinning said spinning solution into an aqueous solution of dimethylformamide to form fibers.

14. A method for producing flame-resistant acrylic fibers, which comprises the steps of:

1. prior to starting solution polymerization, adding to
   (a) a solution of monomers dissolved in dimethylformamide, wherein said monomers consist essentially of from 45 to 70% by weight of acrylonitrile, from 30 to 55% by weight of vinyl chloride or vinylidene chloride and from 0 to 15% by weight of other unsaturated monomer, said solution containing from 35 to 65% by weight of dimethylformamide,
   (b) from 0.7 to 4.0% by weight, based on the weight of (a), of a polymer consisting essentially of from 60 to 80% by weight of acrylonitrile, from 10 to 25% by weight of vinyl chloride or vinylidene chloride and from 8 to 15% by weight of an anionic monomer selected from the group consisting of allylsulfonic acid, methallylsulfonic acid, styrenesulfonic acid, 2-acrylamido-2-methylpropanesulfonic acid, p-methylallyloxybenzenesulfonic acid, allyloxybenzenesulfonic acid, sulfopropyl ester of methacrylic acid, acrylic acid, methacrylic acid, itaconic acid, p-vinylbenzoic acid and alkali metal salts, alkaline earth metal salts and amine salts of said acids, and
   (c) from 0.03 to 1.0% by weight, based on the weight of (a), of zinc salt of an aromatic sulfonic acid selected from the group consisting of benzenesulfonic acid, o-toluenesulfonic acid, p-toluenesulfonic acid, p-phenolsulfonic acid, p-phenolsulfonic acid, p-chlorosulfonic acid, dodecylbenzenesulfonic acid and naphthalenesulfonic acid, whereby to form a polymerization mixture,
2. then polymerizing said polymerization mixture under solution polymerization conditions, in the presence of a radical polymerization catalyst to polymerize from 40 to 80% of the monomers of component (a),
3. then heating the product of step 2 at 60° to 100° C, under reduced pressure, to remove unreacted monomers whereby to obtain a polymer solution,
4. then adding from 0.01 to 1.0% by weight, based on the weight of said polymer solution, of sulfur dioxide, and adding an aqueous solution containing from 50 to 80% by weight of dimethylformamide so that the water content of said polymer solution is from 5.0 to 10.0% by weight whereby to form a spinning solution, and
5. then spinning said spinning solution into an aqueous solution of dimethylformamide to form fibers.

* * * * *